US012510319B2

(12) United States Patent
Prodzenko

(10) Patent No.: US 12,510,319 B2
(45) Date of Patent: Dec. 30, 2025

(54) RECOIL SHOT DETECTION IN AN EXTENDED REALITY SYSTEM

(71) Applicant: STREET SMARTS VR INC., New York, NY (US)

(72) Inventor: Gregory Prodzenko, Philadelphia, PA (US)

(73) Assignee: STREET SMARTS VR INC., New York, NY (US)

( * ) Notice: Subject to any disclaimer, the term of this patent is extended or adjusted under 35 U.S.C. 154(b) by 470 days.

(21) Appl. No.: 18/187,127

(22) Filed: Mar. 21, 2023

(65) Prior Publication Data

US 2024/0318935 A1 Sep. 26, 2024

(51) Int. Cl.
*F41A 19/58* (2006.01)
*F41A 33/06* (2006.01)

(52) U.S. Cl.
CPC ..... *F41A 19/58* (2013.01); *F41A 33/06* (2013.01)

(58) Field of Classification Search
CPC ..... F41A 33/00; F41A 33/02; F41A 33/04; F41A 33/06; F41A 19/58; F41G 3/26
See application file for complete search history.

(56) References Cited

U.S. PATENT DOCUMENTS 8,545,226 B2 * 10/2013 Norden ..... F41G 1/54 434/21
10,274,287 B2 4/2019 Northrup et al.
11,644,278 B2 * 5/2023 Reed ..... F41G 3/2633
2014/0272806 A1 * 9/2014 Hunt ..... F41A 33/06 434/16
2019/0293388 A1 * 9/2019 Barrett ..... F41G 3/2655
2022/0074692 A1 3/2022 Canty et al.

FOREIGN PATENT DOCUMENTS

WO WO 2016/070201 A1 5/2016

OTHER PUBLICATIONS

PCT International Search Report and Written Opinion of the International Searching Authority, mailed Jun. 12, 2024, 8 pages, corresponding to related PCT Application No. PCT/US2024/020444.

* cited by examiner

*Primary Examiner* — Timothy A Musselman
(74) *Attorney, Agent, or Firm* — DLA PIPER LLP (US); Blake W. Jackson; Thomas J. Fuller

(57) ABSTRACT

An apparatus for detecting a firing of a weapon coupled to an extended reality computing system includes a shot detect sensor coupled to a hammer of a weapon and configured to generate a first signal based at least in part on a position of the hammer. A signal comparator is configured to obtain the first signal and a second signal corresponding to a setpoint and to generate a shot detect signal that corresponds to a firing of the weapon. A timer circuit is configured to generate an extended signal based at least in part on the shot detect signal that has a duration greater than the shot detect signal. A shot detect circuit is configured to indicate to an extended reality tracker device that the weapon has been fired based at least in part on the extended signal.

20 Claims, 7 Drawing Sheets

RECOIL SHOT DETECTION IN AN EXTENDED REALITY SYSTEM

CROSS REFERENCE TO RELATED APPLICATIONS

This application is related to the following patents and applications, which are assigned to the assignee of the invention and incorporated by reference herein in their entirety:

- U.S. patent application Ser. No. 16/930,050, entitled "MAGAZINE SIMULATOR FOR USAGE WITH WEAPONS IN A VIRTUAL REALITY SYSTEM," filed on Jul. 15, 2020, and issued as U.S. Pat. No. 11,346,630 on May 31, 2022,
- U.S. patent application Ser. No. 16/930,060, entitled "A VIRTUAL REALITY SYSTEM FOR USAGE WITH SIMULATION DEVICES," filed on Jul. 15, 2020,
- U.S. patent application Ser. No. 17/203,480, entitled "DYNAMIC SCENARIO CREATION IN VIRTUAL REALITY SIMULATION SYSTEMS," filed on Mar. 16, 2021,
- U.S. patent application Ser. No. 17/412,803, entitled "RECOIL MOUNT FOR USAGE WITH WEAPONS IN A VIRTUAL REALITY SYSTEM," filed on Aug. 26, 2021,
- U.S. patent application Ser. No. 17/412,818, entitled "APPARATUS FOR ADAPTING REPLICA WEAPONS TO A VIRTUAL REALITY SYSTEM," filed on Aug. 26, 2021, and
- U.S. patent application Ser. No. 17/412,836, entitled "MOUNT FOR ADAPTING WEAPONS TO A VIRTUAL TRACKER," filed on Aug. 26, 2021,
- U.S. patent application Ser. No. 17/685,153, entitled "VIRTUAL REALITY BATON TRAINING DEVICE," filed on Mar. 2, 2022, and
- U.S. patent application Ser. No. 18/074,949, entitled "MAGNETIC TRACKING IN AN EXTENDED REALITY TRAINING SYSTEM," filed on Dec. 5, 2022.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

Field of the Invention

This application relates to detecting weapon fire, and in particular, a shot detection assembly for a recoiling replica weapon coupled to an extended reality system.

Description of the Related Art

It has long been desired to provide personnel training to improve their skills in aiming and firing shotguns, rifles, handguns, and other weapons. Law enforcement and military training often place trainees into situations that require quick visual and mental assessment of the situation as well as an appropriate response with a weapon. Trainees are often subjected to adverse situations to test their abilities to effectively react.

Traditional training methods in marksmanship and firing tactics for hunters and other sportsmen, police, military personnel, and others, leave much to be desired from the aspects of realism, cost and practicality. Many firing ranges have limited capacity. Moreover, most existing firing ranges do not provide protection for the shooter against the natural elements such as rain or snow. Because of the noise levels normally associated with firing ranges, they are typically located in remote areas requiring people to have to drive to remote locations. The ammunition, targets and use costs for the range, make such training expensive. Furthermore, when live ammunition is used, expense, risks, administrative problems, safety concerns, and government rules and regulations are more burdensome. For training in marksmanship and tactics, it is beneficial to have an indoor range where shooters can fire simulated projectiles against simulated moving targets.

Video games are increasingly more realistic where users may be placed into immersive virtual environments. First-person-view shooting games offer players the ability to perform actions such as walking, crouching, shooting, etc., using a mouse and keyboard. However, these games are usually played in front of a computer where the user is sitting in a chair and are adequate for personnel training. Virtual reality systems may improve gaming experience where the player's movement in the game is dependent on their actions in physical space which makes the game more immersive than a traditional video game. Despite the realism provided by virtual reality systems, players are often provided with game controllers that are either tethered or have the look and feel of toys. As such, existing virtual reality game controllers that are representative guns differ from actual guns in feel and balance, and thus reduces the effectiveness of the training for real life.

Virtual reality weapons training systems using training weapons with realistic feel and functionality are desirable. It is also desirable to incorporate recoil in the training weapons to increase immersion. Immersive experiences are an important part of how training systems provide value. However, existing virtual reality hardware do not accurately or correctly track and detect firing of realistic training weapons.

There may also be other difficulties involved with using realistic weapons in virtual reality systems. For example, a trigger pull may not necessarily translate to a shot being fired on a replica weapon, e.g., an unloaded or jammed gun. As such, connecting a switch to a trigger of a realistic weapon to detect the firing of a shot may not be effective or realistic. In addition, connecting a switch to the firing mechanism or other reciprocating part of a realistic weapon may also be inoperable to effectively detect a shot since the movement of certain firing mechanisms can often be too fast and occur in too short a time duration (e.g., ~15 ms) for detection by conventional virtual reality tracking devices. There is thus a need to provide improved hardware for virtual reality shooting simulators.

SUMMARY OF THE INVENTION

In an embodiment, an apparatus for detecting a firing of a weapon coupled to an extended reality computing system is disclosed. The apparatus comprises a shot detect sensor coupled to a hammer of a weapon. The shot detect sensor is configured to generate a first signal based at least in part on a position of the hammer. The apparatus further comprises a signal comparator that is configured to obtain the first signal from the shot detect sensor and a second signal corresponding to a setpoint. The signal comparator is configured to generate a shot detect signal based at least in part on a comparison of the first signal and the second signal, the shot detect signal corresponding to a firing of the weapon. The apparatus further comprises a timer circuit that is configured to generate an extended signal based at least in part on the shot detect signal. The extended signal has a duration greater than the shot detect signal. The apparatus further comprises a shot detect circuit that is configured to indicate to an extended reality tracker device that the weapon has been fired based at least in part on the extended signal.

In an embodiment, the shot detect sensor is coupled to the hammer via a shaft and the shaft is interfaced with the shot detect sensor such that a rotation of the shaft is translated to the shot detect sensor. In some embodiments, the first signal generated by the shot detect sensor comprises a voltage signal that varies based on a rotation of the shaft.

In some embodiments, the second signal comprises a threshold voltage representative of the setpoint. In some embodiments, the second signal is generated by a potentiometer. The potentiometer is configured to adjust the threshold voltage representative of the setpoint. In another embodiment, the second signal is generated by a voltage reference source. The voltage reference source is configured to output the threshold voltage representative of the setpoint. In an embodiment, a rotation of the hammer past the setpoint causes the shot detect sensor to generate the first signal at a voltage greater than the threshold voltage of the second signal. In a further embodiment, the shot detect signal corresponds to a duration of time at which the voltage of the first signal is greater than the threshold voltage of the second signal.

In an embodiment, the setpoint corresponds to a position of the hammer that corresponds to a firing of the weapon.

In another embodiment, the setpoint corresponds to a position of the hammer that corresponds to a rest output for the signal comparator.

In some embodiments, the timer circuit is configured to generate the extended signal for a predetermined amount of time after the first signal exceeds the second signal.

In an embodiment, data corresponding to the indication that the weapon has been fired is transmitted by the extended reality tracker device to the extended reality computing system. The extended reality computing system is configured to present a virtual shot in a virtual environment that represents the firing of the weapon based at least in part on the data.

In some embodiments, the apparatus comprises a circuit board that is coupled to a lower receiver of the weapon.

In an embodiment, the shot detect sensor comprises a potentiometer.

In an embodiment, an apparatus for detecting a firing of a weapon coupled to an extended reality computing system is disclosed. The apparatus comprises one or more sensors coupled to a hammer of a weapon. The one or more sensors are configured to detect a position of the hammer. The apparatus further comprises a comparator means configured to generate a shot detect signal based on a position of the hammer as detected by the one or more sensors, a timer means configured to generate an extended signal based at least in part on the shot detect signal and a means for indicating to an extended reality tracker device that the weapon has been fired based at least in part on the extended signal.

In some embodiment, a first sensor of the one or more sensors is configured to generate a signal having an adjustable voltage value that corresponds to the position of the hammer.

In an embodiment, the detected position of the hammer comprises a position relative to a setpoint as defined by the one or more sensors.

In another embodiment, the timer means is configured to generate the extended signal for a predetermined amount of time based at least in part on the shot detect signal.

In an embodiment, an extended reality training system is disclosed. The extended reality training system comprises an extended reality computing device and a shot detect device coupled to a weapon. The shot detect device comprises a shot detect sensor coupled to a hammer of a weapon. The shot detect sensor is configured to generate a first signal based at least in part on a position of the hammer. The shot detect device further comprises a signal comparator that is configured to obtain the first signal from the shot detect sensor and a second signal corresponding to a setpoint. The signal comparator is configured to generate a shot detect signal based at least in part on a comparison of the first signal and the second signal, the shot detect signal corresponding to a firing of the weapon. The shot detect device further comprises a timer circuit that is configured to generate an extended signal based at least in part on the shot detect signal. The extended signal has a duration greater than the shot detect signal. The shot detect device further comprises a shot detect circuit that is configured to indicate to an extended reality tracker device that the weapon has been fired based at least in part on the extended signal. The extended reality tracker device is configured to transmit data corresponding to the indication that the weapon has been fired to the extended reality computing device. The extended reality computing device is configured to present a virtual shot in a virtual environment that represents the firing of the weapon based at least in part on the data.

In some embodiments, the shot detect sensor comprises a potentiometer.

The foregoing summary is illustrative only and is not intended to be in any way limiting. These and other illustrative embodiments include, without limitation, apparatus, systems, methods and computer-readable storage media. In addition to the illustrative aspects, embodiments, and features described above, further aspects, embodiments, and features will become apparent by reference to the drawings and the following detailed description.

BRIEF DESCRIPTION OF THE DRAWINGS

The invention is illustrated in the figures of the accompanying drawings which are meant to be exemplary and not limiting, in which like references are intended to refer to like or corresponding parts.

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the invention. Likewise, a reasonably broad scope for claimed or covered subject matter is intended. Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part. Among other things, for example, subject matter may be embodied as methods, devices, components, or systems. Accordingly, embodiments may, for example, take the form of hardware, software, firmware or any combination thereof (other than software per se). The following detailed description is, therefore, not intended to be taken in a limiting sense.

Figure 1:
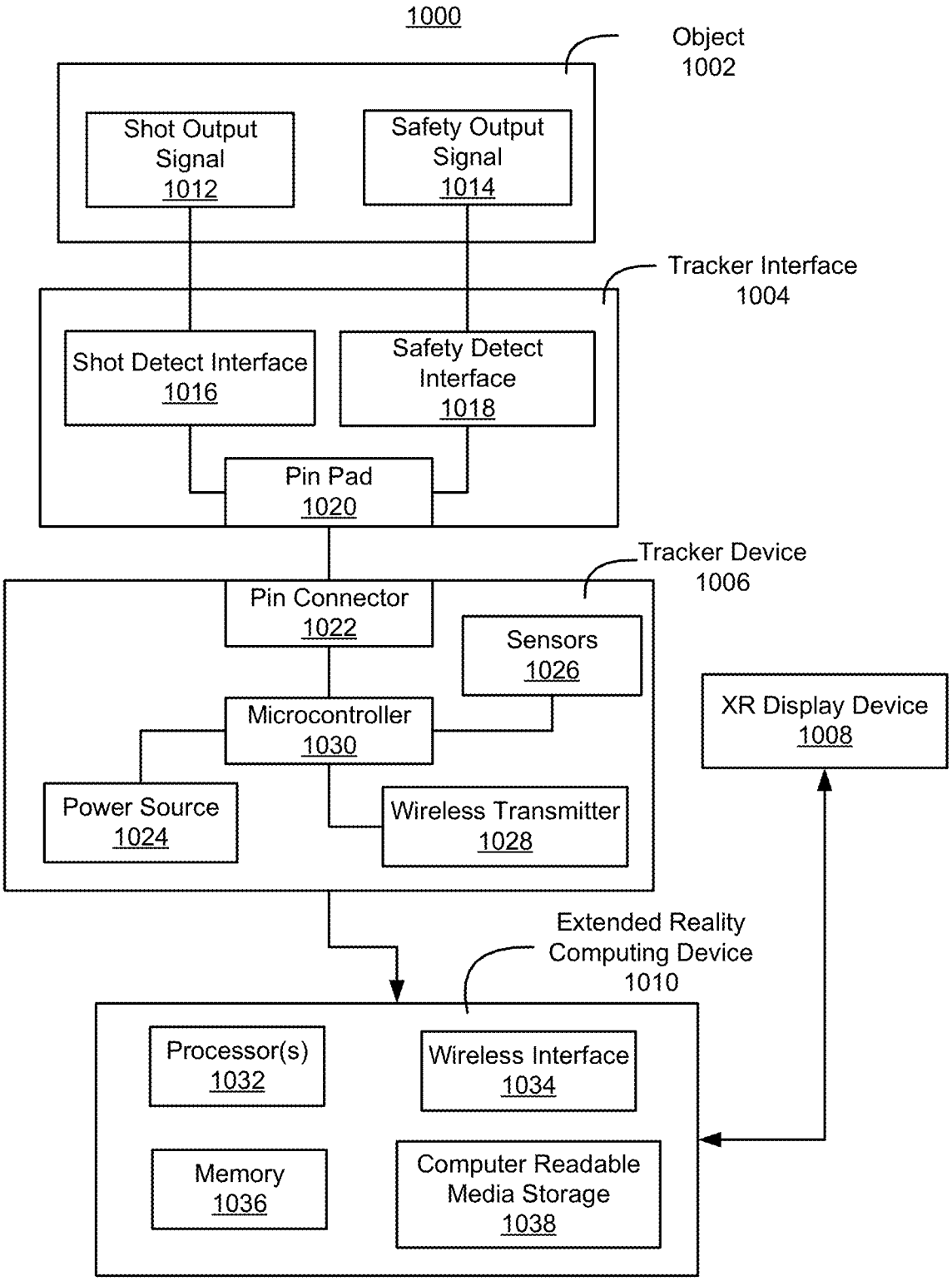
FIG. 1 illustrates a computing system according to an embodiment.
Figure 2:
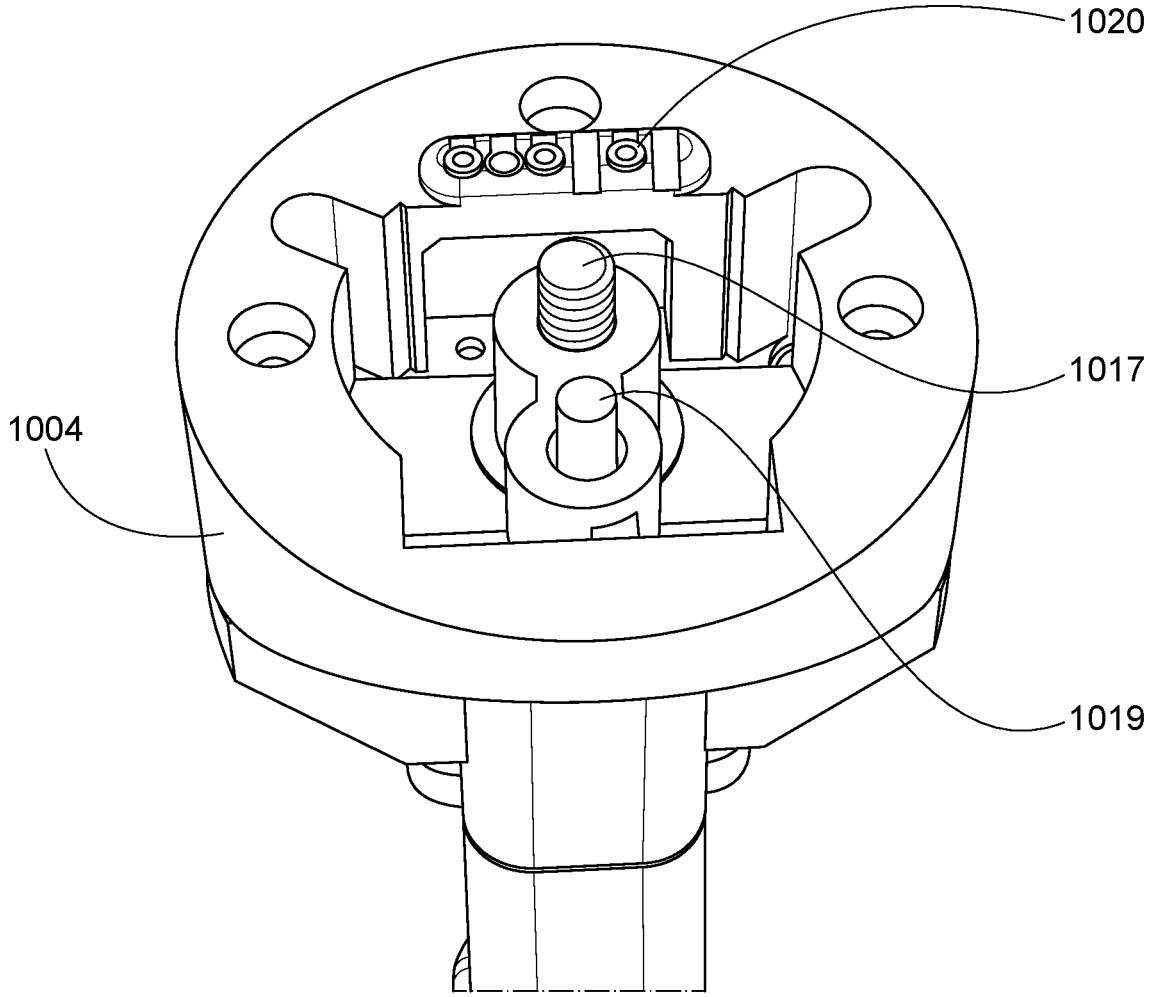
FIG. 2 illustrates a bottom view of a tracker interface according to an embodiment.
Figure 3:
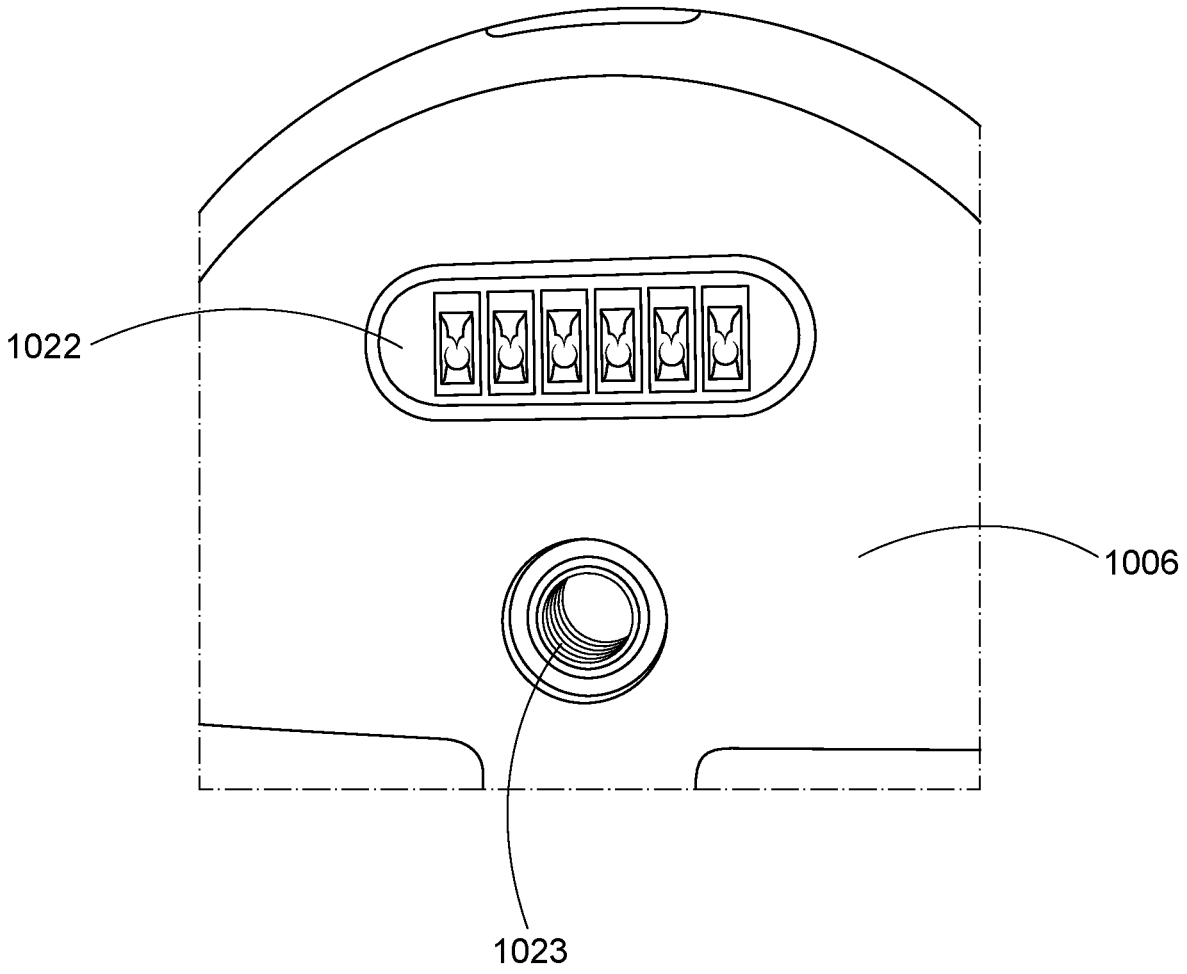
FIG. 3 illustrates a tracker device according to an embodiment.

With reference to FIGS. 1-3, a system 1000 is disclosed that employs extended reality (XR) to train police officers, the military or others in the use of weapon systems or tools such as, e.g., guns, electronic control weapons, grenades, breaching tools or any other weapon systems or tools that may be utilized in specific training scenarios or situations. A user of system 1000 may interact with physical objects, e.g., object 1002, that are integrated into an XR training scenario through the use of a tracking technology and an XR computing device 1010.

The tracking technology may comprise a tracker interface 1004 and a tracker device 1006. Tracker device 1006 may comprise any tracking technology including one or more of optical-based tracking technologies, sound-based tracking technologies, magnetic-based tracking technologies, accelerometer-based tracking technologies, outside-in tracking technologies, electromagnetic tracking technologies or any other tracking technologies that are configured to determine a location, orientation or both location and orientation, of the tracker device 1006 in a three-dimensional (3D) space.

An object 1002, such as, e.g., a real weapon system, a replica weapon system or another object, may be coupled to or otherwise attached to tracker interface 1004. Object 1002 may comprise mechanical or electrical components that generate signals such as, e.g., shot output 1012 and safety output 1014 which may also be provided to tracker interface 1004 by the coupling. For example, the coupling between object 1002 and tracker interface 1004 may be mechanical, electrical, mechanical and electrical, or any other type of coupling.

Tracker interface 1004 includes pin pad 1020, a shot detect interface 1016, a fastener 1017, a safety detect interface 1018 and an optional stabilizing pin 1019. Fastener 1017 and stabilizing pin 1019 are configured to align and couple tracker interface 1004 to a tracker device 1006 (FIG. 3). In an embodiment, fastener 1017 comprises a screw bolt that is configured to mate with a corresponding fastener 1023 of tracker device 1006, e.g., a female screw. Any other component or mechanism for coupling tracker interface 1004 to tracker device 1006 may alternatively be utilized including, but not limited to, screw bolts, latches, adhesive, snap fit, or any other component or mechanism. In an alternative embodiment, tracker interface 1004 may include pin pad 1020 and fastener 1017 without including stabilizing pin 1019.

Shot detect interface 1016 comprises a circuit component that is configured to open and close an electrical circuit based on shot output signal 1012. In some embodiments, a value of shot output signal 1012 may change when object 1002 is fired. For example, in some embodiments, mechanical engagement of a component of object 1002 with a switch of object 1002 may cause a change in the value of shot output signal 1012 and shot detect interface 1016 may open or close the electrical circuit based on the value of shot output signal 1012.

In some embodiments, a mechanical component of object 1002 may alternatively engage against a portion of shot detect interface 1016, e.g., acting as a mechanical shot output signal 1012, and cause shot detect interface 1016 to open or close the circuit accordingly. The electrical connection or signal corresponding to shot output signal 1012 may be carried to a given pin on pin pad 1020 by tracker interface 1004, e.g., wired or wirelessly, via shot detect interface 1016.

Safety detect interface 1018 comprises a circuit component that is configured to open and close an electrical circuit based on safety output signal 1014. In some embodiments, safety output signal 1014 may be activated or a value of safety output signal 1014 may be changed by mechanical engagement of a component of object 1002 with a switch, e.g., movement of a safety selector of object 1002. The electrical connection or signal corresponding to safety output signal 1014 may be carried to a given pin on pin pad 1020 by tracker interface 1004, e.g., wired or wirelessly, via safety detect interface 1018.

In an embodiment, pin pad 1020 includes three pins although any other number of pins may alternatively be utilized. For example, a first pin may correspond to a shot detect interface 1016 that is configured to obtain shot output signal 1012 from object 1002, e.g., a signal that corresponds to a shot being fired by object 1002, a second pin may correspond to safety detect interface 1018 that is configured to obtain a safety output signal 1014 that corresponds to a position of a safety selector of object 1002, and a third pin may correspond to a ground connection or any other signal. The pins of pin pad 1020 may alternatively correspond to any other signals obtained by tracker interface 1004 from object 1002 to be provided to tracker device 1006.

Tracker device 1006 comprises hardware that is configured to track and link actions, events or signals obtained from object 1002 via tracker interface 1004 to XR computing device 1010. For example, in some embodiments, tracker device 1006 comprises pogo pin connector 1022, power source 1024, sensors 1026, wireless transmitter 1028, and microcontroller 1030. Pin pad 1020 may be communicatively or electrically connected to pogo pin connector 1022. Power source 1024 may be connected to microcontroller 1030 and used by microcontroller 1030 to provide a voltage source to components within tracker interface 1004 and object 1002 via pogo pin connector 1022 and pin pad 1020. As such, microcontroller 1030 may receive signals from closed electrical circuits connected to pogo pin connector 1022 and transmit the signals to XR computing device 1010 via wireless transmitter 1028. XR computing device 1010 may process or render the signals using processor(s) 1032 and transmit corresponding images to headset unit 1008 from wireless interface 1034.

Microcontroller 1030 may also provide power to sensors 1026 and wireless transmitter 1028 from power source 1024. Sensors 1026 can detect a position of tracker device 1006 within the x, y and z coordinates of a 3D space, as well as orientation including yaw, pitch and roll. From a user's perspective, an object 1002 connected to tracker device 1006 via tracker interface 1004 may be tracked when pointed up, down, left and right, tilted at an angle, or moved forward or backwards. Sensors 1026 may communicate where the object 1002 is oriented to microcontroller 1030 which sends the data to XR computing device 1010 for processing by processor(s) 1032 and renders corresponding images for transmission by wireless interface 1034 to headset unit 1008.

Signals from pin pad 1020 on tracker interface 1004 may be conveyed to tracker device 1006 via pogo pin connector 1022. Pogo pin connector 1022 may comprise a plurality of spring-loaded pins that are configured to be engaged against and be electrically connected to the pins on pin pad 1020 when tracker interface 1004 is coupled to tracker device 1006. Signals from the pins on pin pad 1020 may be mapped into commands based on the contact connections with corresponding pins on pogo pin connector 1022. Tracker device 1006 is configured to generate commands or other tracking data based on the signals received from tracker interface 1004 and to provide those commands or other tracking data to XR computing device 1010, e.g., wirelessly.

Tracker interface 1004 may be mated with tracker device 1006 by inserting stabilizing pin 1019 into a stabilizing pin recess (not illustrated) of tracker device 1006. The stabilizing pin 1019 provides a proper alignment and contact between pin pad 1020 and pogo pin connector 1022. Tracker device 1006 may further include image sensors and/or non-optical sensors (e.g., utilizing sound waves or magnetic fields) that can be installed in hardware to track the movement of the object 1002 or the user's body. According to another embodiment, optical markers may be placed on tracker device 1006 (or alternatively on tracker interface 1004 or object 1002) for motion tracking using cameras to track movement of a user or object 1002.

XR computing device 1010 may comprise a virtual reality (VR) system, a mixed-reality (MR) system, an augmented reality (AR) system or any other type of XR system. In some embodiments, XR computing device 1010 may comprise a combination of two or more of VR, MR, AR and any other XR technologies. While described herein as XR training scenarios, one or more of VR, MR and AR training scenarios may also or alternatively be implemented.

In an example, the user may be provided with an object 1002 such as, e.g., an actual weapon system, a training weapon system that simulates an actual weapon system, a tool or another object, that is connected to XR computing device 1010 via the tracker interface 1004 and tracker device 1006.

The user may wear an XR display device 1008 such as, e.g., a VR, MR, AR or any other XR goggle, headset, smart glasses or another display device, that is connected to XR computing device 1010 and is configured to present an XR training scenario to the user that is generated by XR computing device 1010. XR display device 1008 comprises a display such as, e.g., a head mounted display, monitor, smart glass, or other display, that a user can place over or near the user's eyes to create an immersive visual experience. XR display device 1008 may also comprise one or more audio devices that are configured to present audio to the user. Throughout the XR training scenario, the user's interaction with or use of the object 1002 may be tracked by the tracking technology and provided to XR computing device 1010 for integration into the XR training scenario presented to the user via XR display device 1008.

XR display device 1008 may comprise a head mounted display, also including components similar to tracker device 1006, that a user can place over the user's eyes. The XR display device 1008 may be configured to communicate with the XR computing device 1010 to present the XR training scenario. Additionally, the XR display device 1008 may be configured with positioning and/or motion sensors to provide user motion inputs to XR computing device 1010. When wearing the XR display device 1008, the view may shift as the user looks up, down, left and right. The view may also change if the user tilts their head at an angle or move their head forward or backward without changing the angle of gaze. Sensors on XR display device 1008 may communicate to processor(s) 1032 where the user is looking, and the processor(s) 1032 may render corresponding images to the head mounted display of XR display device 1008. Sensors, as disclosed herein, can detect signals of any form, including electromagnetic signals, acoustic signals, optical signals and mechanical signals.

XR computing device 1010 includes processor(s) 1032, wireless interface 1034, memory 1036, and computer readable media storage 1038. Processor(s) 1032 may be configured to execute XR training scenarios stored within memory 1036 and/or computer readable media storage 1038, to communicate data to and from memory 1036, and to control operations of the XR computing device 1010. The processor(s) 1032 may comprise central processing units, auxiliary processors among several processors, and graphics processing units. Memory 1036 may include any one or combination of volatile memory elements (e.g., random access memory (RAM). Computer readable media storage 1038 may comprise non-volatile memory elements (e.g., read-only memory (ROM), hard drive, etc.). Wireless interface 1034 may comprise a network device operable to connect to a wireless computer network for facilitating communications and data transfer with tracker device 1006 and XR display device 1008.

An XR training scenario may comprise an audio/visual interactive interface that enables a trainee to interact with a three-dimensional first-person-view environment using a tracker device 1006 coupled to an object 1002 via a tacker interface 1004. XR computing device 1010 may receive signals or commands from tracker device 1006 and XR display device 1008 to generate corresponding data (including audio and video data) for depiction in the XR training scenario environment.

With reference now to FIGS. 4-7, an embodiment of shot detection hardware and methods for detecting weapon fire will now be described. In some cases, weapons producing rapid fire and recoil, such as air guns, machine guns, and semi-automatic guns, may make it difficult for some tracker devices 1006 to track each individual shot accurately due to the short duration of time that the hammer 1102 or other firing mechanism is moving or rotating for each shot. In an embodiment, the shot detection hardware may be mounted on an object 1002 such as, e.g., a weapon system, including a rotating hammer 1102, to communicate firing events to XR computing device 1010 without changing the way the object 1002 operates. The XR system may receive the firing events and represent the firing events in an extended environment such that a virtual shot is synchronized with physical recoil of the object 1002.

According to one embodiment, the shot detection hardware may comprise a mechanism that is coupled to a hammer 1102 of a firearm weapon. The hammer 1102 may comprise a part of the weapon that strikes a firing pin or primer of a cartridge to ignite a propellant and fire a projectile. The hammer 1102 rotates upon actual firing of the weapon. To track the firing, a shot detect sensor 1202, such as, e.g., a potentiometer, encoder, resolver, hall effect sensor or another sensor device that is configured to measure movement or rotation at least a portion of the hammer 1102, may be connected to the hammer 1102 to correlate the movement or rotation of the hammer 1102 to a firing event. As such, the disclosed shot detection hardware can detect actual firing of a weapon based on movement or rotation of the hammer 1102 rather than on a trigger pull, which may or may not actually cause a weapon to fire. For example, in the event that there is a jam, no ammunition or any other issue with the weapon, a trigger pull may not actually cause a shot to occur. By tracking movement or rotation of the hammer 1102, the disclosed shot detection hardware may also synchronize firing events with physical recoil of the firearm weapon. It is also noted that the shot detection hardware is not limited to measuring movement or rotation of the hammer 1102 and may also be configured to measure movement or rotation of other internal and external weapon components involved in the firing of the weapon including, e.g., a pressure sensor that is configured to measure the release of a compressed gas due to firing of the weapon system, a linear or rotary position sensor that is configured to measure a position or translation of a bolt carrier or any other sensor that is configured to measure a portion of the weapon system that changes state, position or otherwise as part of the firing process.

Figure 4:
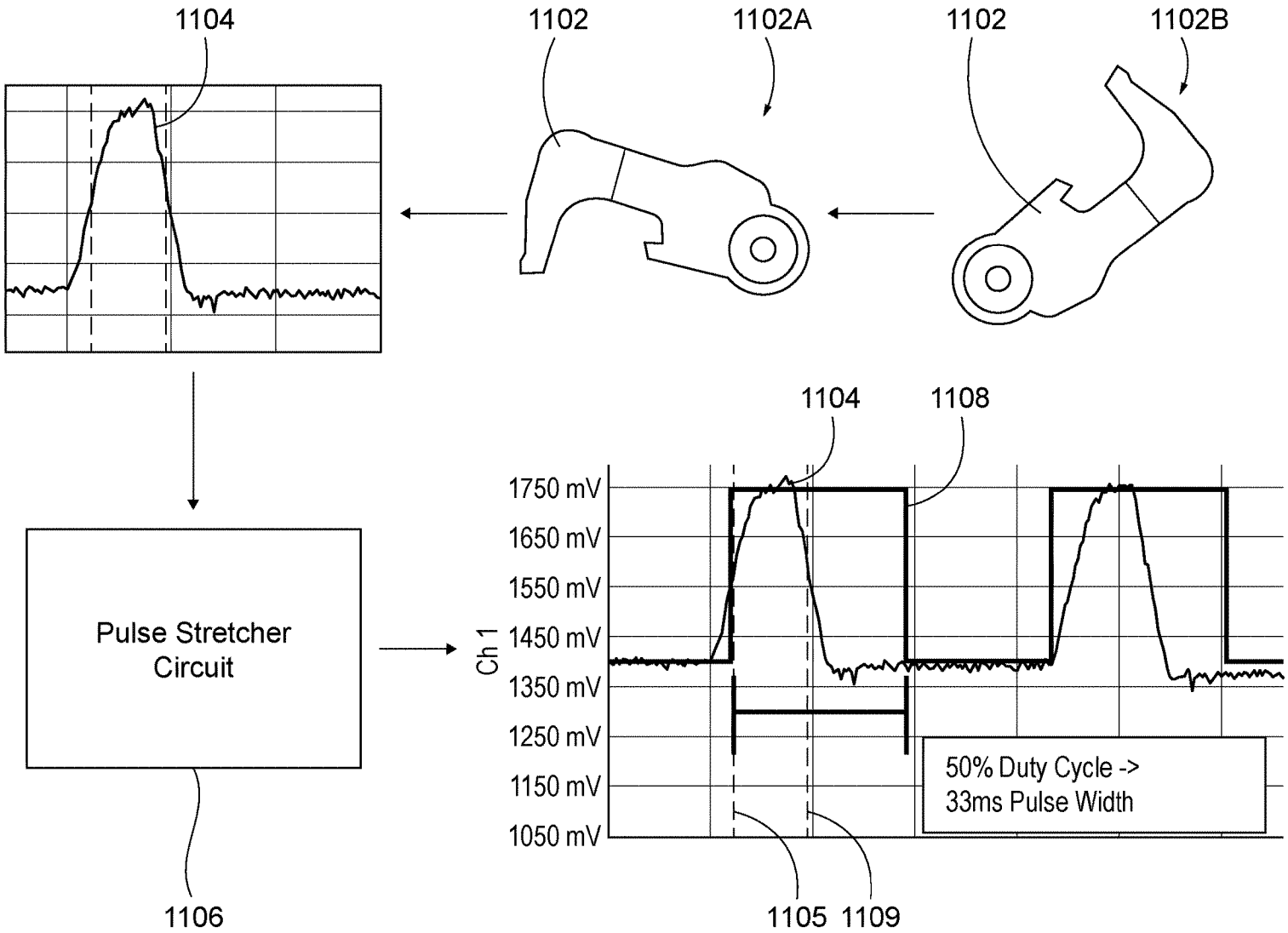
FIG. 4 illustrates a firing signal diagram for detecting a shot from a weapon according to an embodiment.

With reference to FIG. 4, a firing signal diagram for detecting a shot from a weapon according to an embodiment will be described. The disclosed shot detection hardware may be attached to a shot detect sensor 1202 (FIG. 5) to track the position of a hammer 1102 from a ready/cocked position 1102A to a fired position 1102B. The shot detect sensor 1202 generates a positive signal 1104 during instances when the hammer 1102 is away from position 1102A. Upon a rotation from position 1102A to 1102B and back to 1102A, the shot detect sensor 1202 may generate a pulse or sinusoidal signal 1104 representative of weapon fire. As shown in FIG. 4, in this example, the signal 1104, comprises a short signal, e.g., 15 ms or less, which may be too short to be effectively detected by some tracker devices 1006. In order to ensure that a tracker device 1006 is able to accurately detect the shots, the disclosed shot detection hardware comprises a pulse stretch circuit 1106 that receives the signal 1104 from shot detect sensor 1202 as an input and generates an extended signal 1108 as an output that is long enough to be detectable by a tracker device 1006, e.g., at least 33 ms in length for some tracker devices 1006 although other durations may alternatively be utilized.

In some embodiments, pulse stretch circuit 1106 is attached as part of shot detection hardware to the object 1002, e.g., a weapon system, and the extended signal 1108 is provided from the pulse stretch circuit 1106 to tracker interface 1004 as shot detect signal 1012 (FIG. 1). In other embodiments, pulse stretch circuit 1106 may be integrated into tracker interface 1004 where, for example, signal 1104 is obtained by tracker interface 1004 from the shot detect sensor 1202 as shot detect signal 1012 and extended signal 1108 is provided as an output from tracker interface 1004 to tracker device 1006. In other embodiments, pulse stretch circuit 1106 may be integrated into tracker device 1006 where, for example, signal 1104 is obtained by tracker device 1006 from tracker interface 1004 via shot detect interface 1015, pin pad 1020 and pogo pin connector 1022.

Figure 5:
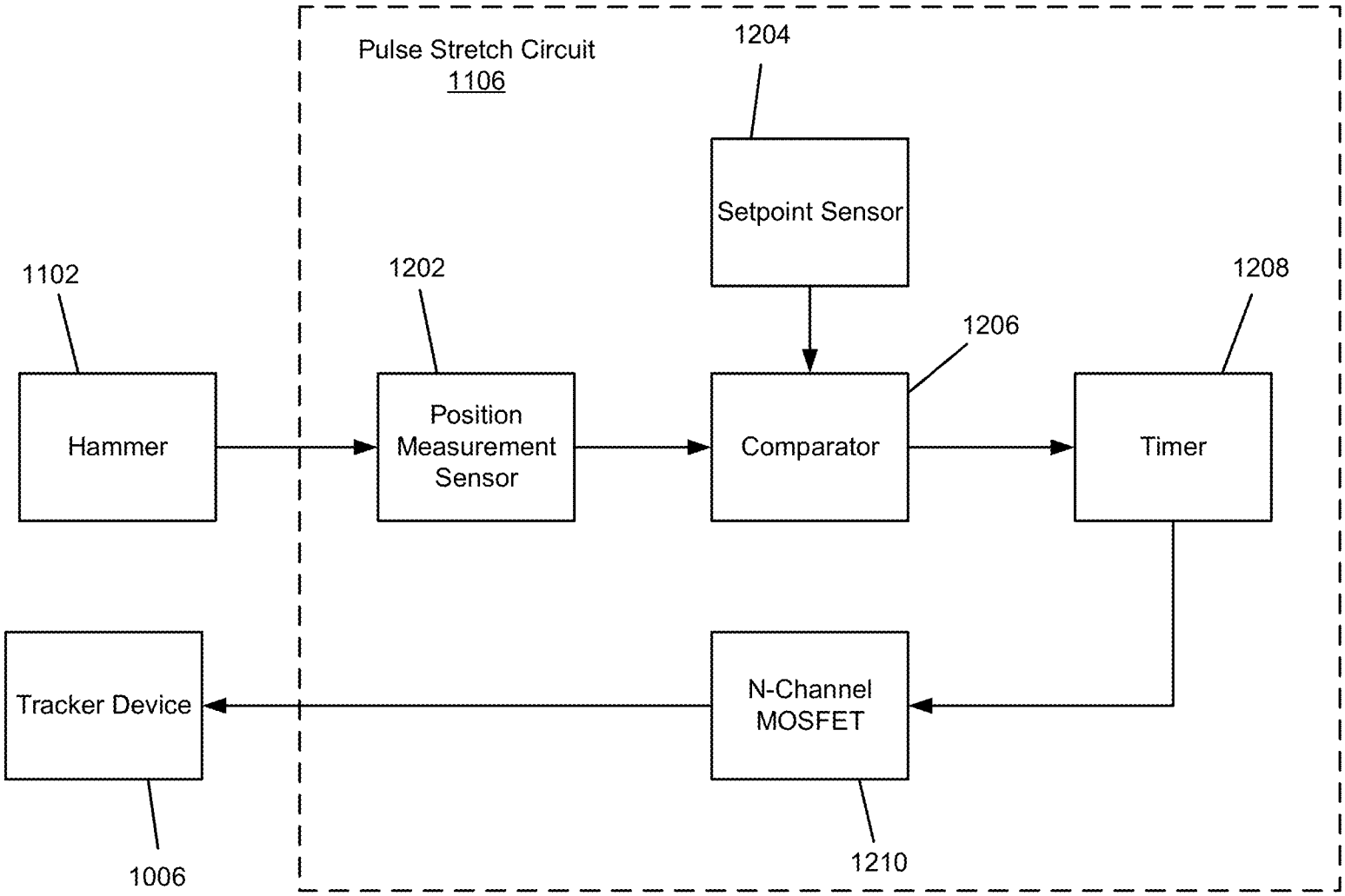
FIG. 5 illustrates a schematic diagram of a shot detection circuit according to an embodiment.
Figure 6:
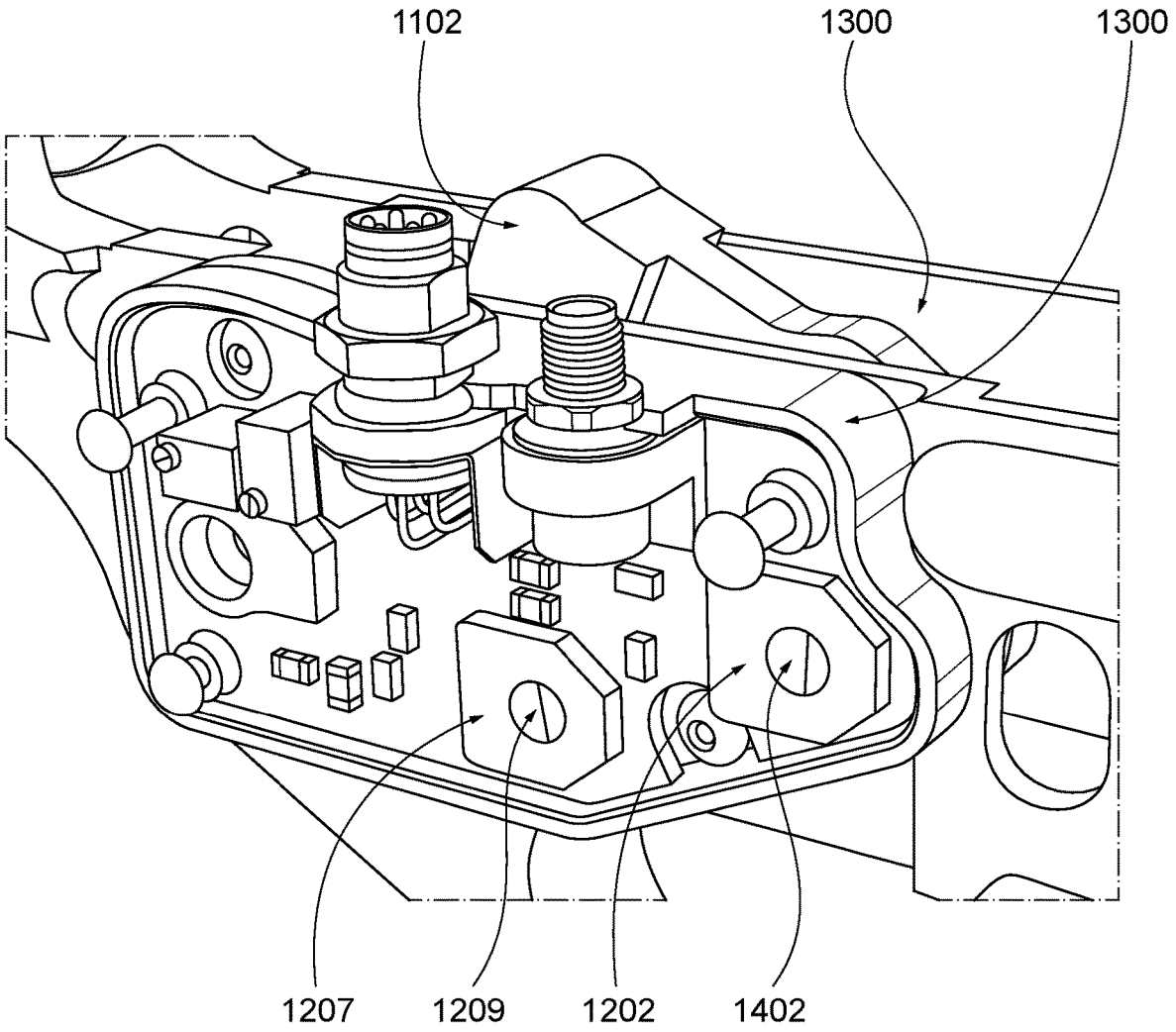
FIGS. 6 and 7 illustrate shot detection hardware according to an embodiment.

With reference to FIG. 5 a schematic diagram of an example shot detection circuit according to an embodiment will be described. A shot detection circuit may be interfaced with an object 1002 such as, e.g., a weapon system, to enable detection of firing events. The weapon system may comprise a replica or actual firearm capable of firing a projectile or blanks and producing recoil. The shot detection circuit comprises pulse stretch circuit 1106 coupled to hammer 1102 and tracker device 1006 directly or via tacker interface 1004. Hammer 1102 is coupled to pulse stretch circuit 1106 via shot detect sensor 1202, e.g., a potentiometer, encoder or other sensor device, to measure the position/rotation of the hammer 1102. In some embodiments, the shot detect sensor 1202 may be coupled to the hammer 1102 via a shaft and generates a voltage signal that varies based on mechanical rotation of hammer 1102 and representative of the angle or position of the hammer, e.g., as shown in FIG. 6. As an example, the voltage signal generated by shot detect sensor 1202 may comprise an analog signal having a value based on the mechanical rotation of the hammer.

In some embodiments, pulse stretch circuit 1106 further comprises a setpoint sensor 1204, e.g., a potentiometer, encoder or another sensor device, that is configured at an initial or ready position of hammer 1102 to establish a setpoint and generate a threshold voltage signal representative of the angle or position of the setpoint. The setpoint may be representative of an unfired state of the weapon, a fired state of the weapon or any other threshold setpoint. For example, setpoint sensor 1204 can be used to adjust the setpoint of the circuit. The setpoint may comprise a position of the hammer 1102 that is used to establish a rest output (e.g., '0' voltage), a fired output, e.g., a value corresponding to a firing of the weapon, or any other setpoint.

Pulse stretch circuit 1106 comprises a signal comparator 1206 that is configured to receive the voltage signals from shot detect sensor 1202 and setpoint sensor 1204. The voltage signal from shot detect sensor 1202 may be compared with the voltage signal from setpoint sensor 1204 by signal comparator 1206 to determine a position of the hammer 1102 relative to the setpoint. In another embodiment, setpoint sensor 1204 may alternatively be replaced by a reference voltage signal source that provides a reference voltage corresponding to the setpoint.

The output from the signal comparator 1206 is received by a timer 1208. Timer 1208 may comprise a signal extending circuit that receives voltage signals, e.g., signal 1104, from the signal comparator 1206 and generates an extended signal by extending the signals from the signal comparator 1206, e.g., as shown by extended signal 1108 in FIG. 4.

In normal operation, when the trigger is pulled, the hammer 1102 rotates to cause a firing of the weapon, e.g., strike a firing pin or in any other manner, and then returns back to the cocked position. During rotation, the hammer rotates past a setpoint which triggers the shot detection circuit. The rotation of the hammer 1102 past the setpoint causes shot detect sensor 1202 to generate voltages greater than a threshold voltage of setpoint sensor 1204. In an example embodiment, the setpoint may be set at a position where the hammer has been released from the trigger/sear and is moving towards firing but the weapon system has not yet fired. Signal comparator 1206 may generate a positive voltage pulse or sinusoidal (e.g., firing) signal 1104 for a duration of time of which the voltage signal from shot detect sensor 1202 exceeds the threshold voltage of setpoint sensor 1204. According to another embodiment, signal comparator 1206 need only to receive the voltage signal from shot detect sensor 1202 and compare it with a reference voltage signal from a reference voltage source.

The pulse or sinusoidal signal 1104 is representative of a shot fired by the weapon and is extended by the timer 1208 to generate extended signal 1108. The timer 1208 may create the extended signal by holding the signal 1104 received from the signal comparator 1206 for a predetermined amount of time after signal 1104 crosses the setpoint. As an example, when the voltage of the signal 1104 increases and crosses the setpoint voltage threshold during firing of the weapon as denoted by the left side vertical dashed line 1105 in FIG. 4, e.g., exceeds the voltage threshold, timer 1208 may begin generating the extended signal 1108 and continue generating the extended signal 1108 for the predetermined amount of time even though signal 1104 crosses the setpoint threshold and falls below the setpoint as denoted by the right side vertical dashed line 1109 in FIG. 4. The extended signal 1108 is transmitted to an N-channel MOSFET 1210 which closes a circuit within a tracker interface 1004 or tracker device 1006 to indicate to tracker interface 1004 or tracker device 1006 that the weapon has been fired and a shot has occurred. While an N-channel MOSFET is described in an embodiment, any other component or methods may alternatively be utilized to indicate to tracker interface 1004 or tracker device 1006 that the weapon has been fired and a shot has occurred including the use of other type of transistors, circuit elements, or any other mechanism.

The extended signal 1108 may be held or extended long enough by timer 1208 for the tracker device 1006 to detect the shot (e.g., 33 ms or another amount of time). Shots detected by the tracker device 1006 may be transmitted to XR computing system 1010 and represented as virtual shots in a virtual environment. The shot detection circuit is configured to enable a synchronization of virtual shots with recoil from actual firing of the weapon.

Figure 7:
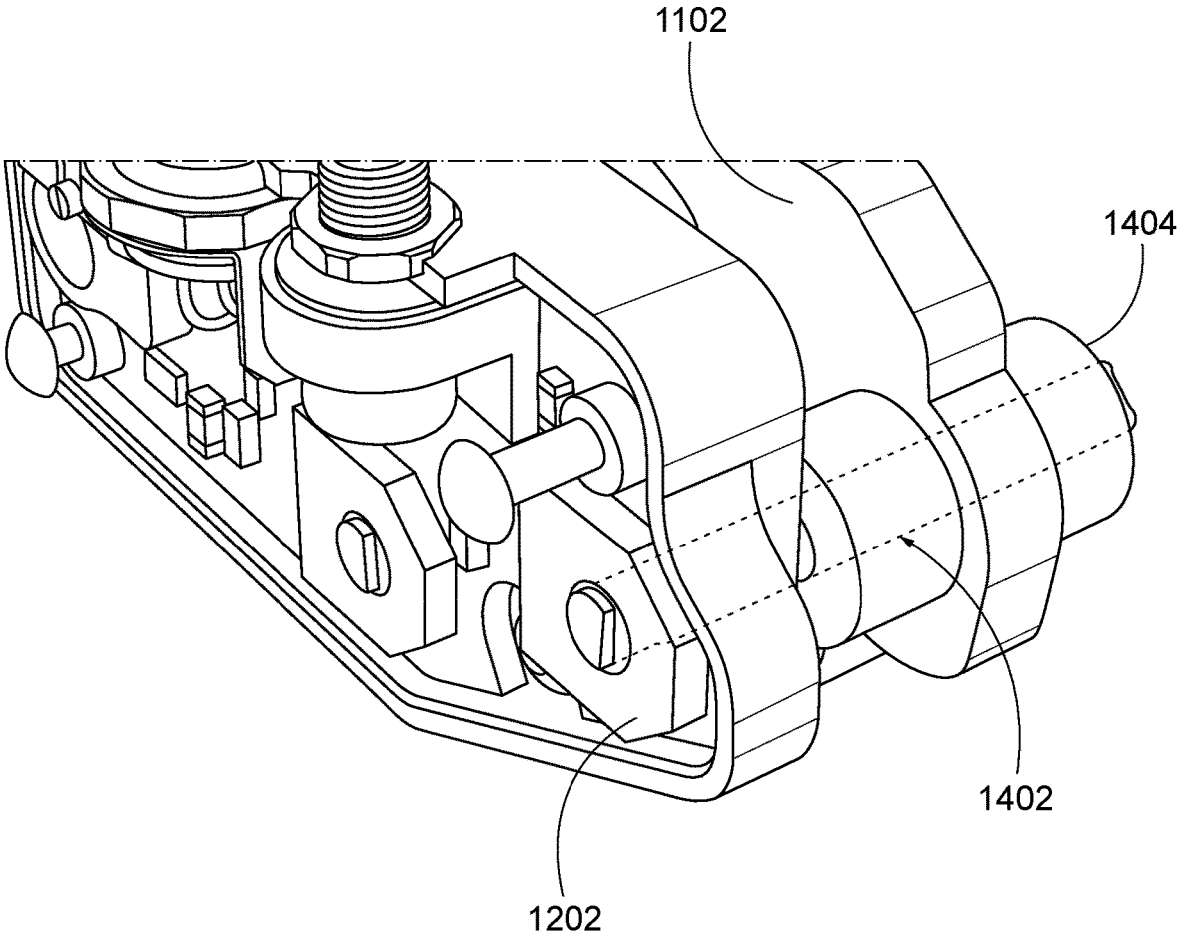

With reference to FIGS. 6 and 7, example shot detection hardware 1107 according to an embodiment will be described. The disclosed shot detection hardware 1107 comprises pulse stretch circuit 1106 and is coupled to a lower receiver 1300 of a firearm weapon. Shot detect sensor 1202, e.g., shown as a potentiometer in FIGS. 6 and 7, is coupled to hammer 1102 via a shaft 1402. The shaft 1402 may comprise a rod or pin that is inserted into a center of a pivot hole of hammer 1102 and secured by a set screw 1404. A circuit facing end of shaft 1402 is interfaced with shot detect sensor 1202 such that a rotation of shaft 1402 is translated to shot detect sensor 1202.

In some embodiments, a trigger sensor 1207, e.g., shown as a potentiometer in FIGS. 6 and 7, may be coupled to a shaft 1209 that may comprise a rod or pin that is inserted into a pivot hole of the trigger assembly and is configured to track movement of the trigger, e.g., in a similar manner to shot detect sensor 1202 tracking movement of the hammer. In some embodiments, a signal corresponding to the movement of the trigger may be generated by trigger sensor 1207 and transmitted to XR computing system 1010. XR computing system 1010 may utilize the signal corresponding to the movement of the trigger separately or in conjunction with the signal corresponding to shots detected by the tracker device 1006 to determine when shots have been fired, whether or not the weapon is being fired on fully automatic, burst fire or semi-automatic firing modes, whether or not there was a misfire without a trigger pull or for any other reason. In one example, a single trigger pull and release with multiple shots detected as being fired may indicate that the weapon is on a burst or fully automatic mode of fire, a single trigger pull without release and a limited or specific number of shots detected as being fired may indicate that the weapon is on a burst mode of fire, a single trigger pull without release and many shots detected as being continuously fired may indicate that the weapon is on a fully-automatic mode of fire and a single trigger pull with or without release and a single shot detected as being fired may indicate that the weapon is on a semi-automatic mode of fire.

FIGS. 1 through 7 are conceptual illustrations allowing for an explanation of the embodiments of the invention. Notably, the figures and examples above are not meant to limit the scope of the invention to a single embodiment, as other embodiments are possible by way of interchange of some or all of the described or illustrated elements. Moreover, where certain elements of the invention can be partially or fully implemented using known components, only those portions of such known components that are necessary for an understanding of the embodiments of the invention are described, and detailed descriptions of other portions of such known components are omitted so as not to obscure the embodiments of the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the embodiments of the invention encompasses present and future known equivalents to the known components referred to herein by way of illustration.

It should be understood that various aspects of the embodiments of the invention could be implemented in hardware, firmware, software, or combinations thereof. In such embodiments, the various components and/or steps would be implemented in hardware, firmware, and/or software to perform the functions of the present invention. That is, the same piece of hardware, firmware, or module of software could perform one or more of the illustrated blocks (e.g., components or steps). In software implementations, computer software (e.g., programs or other instructions) and/or data is stored on a machine-readable medium as part of a computer program product and is loaded into a computer system or other device or machine via a removable storage drive, hard drive, or communications interface. Computer programs (also called computer control logic or computer-readable program code) are stored in a main and/or secondary memory, and executed by one or more processors (controllers, or the like) to cause the one or more processors to perform the functions of the embodiments of the invention as described herein. In this document, the terms "machine readable medium," "computer-readable medium," "computer program medium," and "computer usable medium" are used to generally refer to media such as a random access memory (RAM); a read only memory (ROM); a removable storage unit (e.g., a magnetic or optical disc, flash memory device, or the like); a hard disk; or the like.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

What is claimed is:

1. An apparatus for detecting a firing of a weapon coupled to an extended reality computing system, the apparatus comprising:

a shot detect sensor coupled to a hammer of a weapon, the shot detect sensor being configured to generate a first signal based at least in part on a position of the hammer;

a signal comparator that is configured to obtain the first signal from the shot detect sensor and a second signal corresponding to a setpoint, the signal comparator being configured to generate a shot detect signal based at least in part on a comparison of the first signal and the second signal, the shot detect signal corresponding to a firing of the weapon;

a timer circuit that is configured to generate an extended signal based at least in part on the shot detect signal, the extended signal having a duration greater than the shot detect signal; and a shot detect circuit that is configured to indicate to an extended reality tracker device that the weapon has been fired based at least in part on the extended signal.

2. The apparatus of claim 1 wherein the shot detect sensor is coupled to the hammer via a shaft, the shaft being interfaced with the shot detect sensor such that a rotation of the shaft is translated to the shot detect sensor.

3. The apparatus of claim 2 wherein the first signal generated by the shot detect sensor comprises a voltage signal that varies based on a rotation of the shaft.

4. The apparatus of claim 1 wherein the second signal comprises a threshold voltage representative of the setpoint.

5. The apparatus of claim 4 wherein the second signal is generated by a potentiometer, the potentiometer being configured to adjust the threshold voltage representative of the setpoint.

6. The apparatus of claim 4 wherein the second signal is generated by a voltage reference source, the voltage reference source being configured to output the threshold voltage representative of the setpoint.

7. The apparatus of claim 4 wherein a rotation of the hammer past the setpoint causes the shot detect sensor to generate the first signal at a voltage greater than the threshold voltage of the second signal.

8. The apparatus of claim 7 wherein the shot detect signal corresponds to a duration of time at which the voltage of the first signal is greater than the threshold voltage of the second signal.

9. The apparatus of claim 1 wherein the setpoint corresponds to a position of the hammer that corresponds to a firing of the weapon.

10. The apparatus of claim 1 wherein the setpoint corresponds to a position of the hammer that corresponds to a rest output for the signal comparator.

11. The apparatus of claim 1 wherein the timer circuit is configured to generate the extended signal for a predetermined amount of time after the first signal exceeds the second signal.

12. The apparatus of claim 1 wherein data corresponding to the indication that the weapon has been fired is transmitted by the extended reality tracker device to the extended reality computing system, the extended reality computing system being configured to present a virtual shot in a virtual environment that represents the firing of the weapon based at least in part on the data.

13. The apparatus of claim 1 wherein the apparatus comprises a circuit board that is coupled to a lower receiver of the weapon.

14. The apparatus of claim 1 wherein the shot detect sensor comprises a potentiometer.

15. An apparatus for detecting a firing of a weapon coupled to an extended reality computing system, the apparatus comprising:

one or more sensors coupled to a hammer of a weapon, the one or more sensors being configured to detect a position of the hammer;

a comparator means configured to generate a shot detect signal based on a position of the hammer as detected by the one or more sensors;

a timer means configured to generate an extended signal based at least in part on the shot detect signal; and a means for indicating to an extended reality tracker device that the weapon has been fired based at least in part on the extended signal.

16. The apparatus of claim 15 wherein a first sensor of the one or more sensors is configured to generate a signal having an adjustable voltage value that corresponds to the position of the hammer.

17. The apparatus of claim 15 wherein the detected position of the hammer comprises a position relative to a setpoint as defined by the one or more sensors.

18. The apparatus of claim 15 wherein the timer means is configured to generate the extended signal for a predetermined amount of time based at least in part on the shot detect signal.

19. An extended reality training system comprising:

an extended reality computing device; and a shot detect device coupled to a weapon, the shot detect device comprising:

a shot detect sensor coupled to a hammer of a weapon, the shot detect sensor being configured to generate a first signal based at least in part on a position of the hammer;

a signal comparator that is configured to obtain the first signal from the shot detect sensor and a second signal corresponding to a setpoint, the signal comparator being configured to generate a shot detect signal based at least in part on a comparison of the first signal and the second signal, the shot detect signal corresponding to a firing of the weapon;

a timer circuit that is configured to generate an extended signal based at least in part on the shot detect signal, the extended signal having a duration greater than the shot detect signal; and a shot detect circuit that is configured to indicate to an extended reality tracker device that the weapon has been fired based at least in part on the extended signal, the extended reality tracker device being configured to transmit data corresponding to the indication that the weapon has been fired to the extended reality computing device, the extended reality computing device being configured to present a virtual shot in a virtual environment that represents the firing of the weapon based at least in part on the data.

20. The extended reality training system of claim 19 wherein the shot detect sensor comprises a potentiometer.

* * * * *